US007619590B2

(12) United States Patent
Kim

(10) Patent No.: US 7,619,590 B2
(45) Date of Patent: Nov. 17, 2009

(54) PLASMA DISPLAY PANEL AND MODULE THEREOF

(75) Inventor: Yun Gi Kim, Busan (KR)

(73) Assignee: LG Electronics Inc., Seoul (KR)

( * ) Notice: Subject to any disclaimer, the term of this patent is extended or adjusted under 35 U.S.C. 154(b) by 484 days.

(21) Appl. No.: 10/926,341

(22) Filed: Aug. 26, 2004

(65) Prior Publication Data

US 2005/0078059 A1 Apr. 14, 2005

(30) Foreign Application Priority Data

Aug. 27, 2003 (KR) ..... 10-2003-0059506

(51) Int. Cl.
*G09G 3/28* (2006.01)

(52) U.S. Cl. ..... 345/68; 345/60; 313/484; 313/498; 315/169.4

(58) Field of Classification Search ..... 345/60, 345/68; 313/484, 498
See application file for complete search history.

(56) References Cited

U.S. PATENT DOCUMENTS

| | | | | |
|---|---|---|---|---|
| 5,369,338 | A * | 11/1994 | Kim | 315/169.4 |
| 6,118,214 | A * | 9/2000 | Marcotte | 313/582 |
| 6,559,815 | B1 * | 5/2003 | Kang et al. | 345/60 |
| 6,621,234 | B2 * | 9/2003 | Itoh et al. | 315/169.4 |
| 6,677,664 | B2 * | 1/2004 | Inoue et al. | 257/668 |
| 6,750,937 | B2 * | 6/2004 | Karasawa et al. | 349/153 |
| 6,989,817 | B2 * | 1/2006 | Tajima | 345/156 |
| 7,091,665 | B2 * | 8/2006 | Nomoto et al. | 313/583 |
| 7,321,345 | B2 * | 1/2008 | Choi et al. | 345/60 |
| 2002/0043621 | A1 * | 4/2002 | Aitken | 250/281 |
| 2002/0154075 | A1 * | 10/2002 | Sato et al. | 345/60 |
| 2004/0232838 | A1 * | 11/2004 | Masuda et al. | 313/582 |

FOREIGN PATENT DOCUMENTS

| | | | |
|---|---|---|---|
| CN | 1279458 | | 1/2001 |
| EP | 1 065 694 | A1 | 1/2001 |
| KR | 10-2004-0088939 | A | 10/2004 |
| WO | WO 03/003400 | A1 | 1/2003 |

* cited by examiner

*Primary Examiner*—Sumati Lefkowitz
*Assistant Examiner*—Grant D Sitta
(74) *Attorney, Agent, or Firm*—KED & Associates, LLP

(57) ABSTRACT

A plasma display panel includes scan electrode lines, sustain electrode lines and data electrode lines formed within a display area. A common electrode line is formed along a side of the device at a non-display area and is commonly connected to the sustain electrode lines. A first pad portion is formed at a non-display area on a side of the device, and wires carrying scan signals are connected to the scan electrode lines at the first pad portion. A second pad portion is also formed at a non-display area on either a side edge, an upper edge or a bottom edge of the device, and a conductive path carries a sustain signal to the common line through the second pad portion.

15 Claims, 16 Drawing Sheets

PLASMA DISPLAY PANEL AND MODULE THEREOF

This application claims the benefit of the Korean Patent Application No. 2003-0059506, filed on Aug. 27, 2003, which is hereby incorporated by reference.

BACKGROUND OF THE INVENTION

1. Field of the Invention

The present invention relates to a plasma display panel and a module thereof, and more particularly to a plasma display panel and a module thereof that is adaptive for reducing inductance as well as simplifying an assembly process of an integrated sustainer board.

2. Description of the Related Art

Recently, a plasma display panel (hereinafter, referred to as "PDP") has been the center of attention as a flat panel display since it is easy to be made into a large-sized panel. The PDP generally displays a picture by controlling the gas discharge period of each pixel in accordance with digital video data. Such a PDP includes three electrodes as in FIG. 1, and is typically a AC type of PDP which is driven by AC voltage.

FIG. 1 illustrates a magnified discharge cell that constitutes an AC type PDP of prior art.

A discharge cell 30 shown in FIG. 1 includes an upper plate having a sustain electrode pair 12A, 12B, an upper dielectric layer 14 and a protective film 16 which are sequentially formed on an upper substrate 10; and a lower plate having a data electrode 20, a lower dielectric layer 22, barrier ribs 24 and a phosphorus layer 26 that are sequentially formed on a lower substrate 18.

Each of the sustain electrode pair 12A, 12B includes a transparent electrode and a metal electrode that is for compensating the high resistance of the transparent electrode. The sustain electrode pair 12A, 12B is divided into a scan electrode 12A and a sustain electrode 12B. The scan electrode 12A supplies a scan signal for address discharge and a sustain signal for sustain discharge, and the sustain electrode 12B supplies a sustain signal. The data electrode 20 is formed to cross the sustain electrode pair 12A, 12B. The data electrode 20 supplies a data signal for address discharge.

Electric charges generated by the discharge are accumulated at the upper dielectric layer 14 and the lower dielectric layer 22. The protective film 16 prevents the damage of the upper dielectric layer 14 caused by sputtering and increases the emission efficiency of secondary electrons. The dielectric layer 14, 22 and the protective film 16 enable to reduce the discharge voltage applied from the outside.

The barrier ribs 24 provide a discharge space together with the upper and lower substrates 10 and 18. And the barrier ribs 24 are formed in parallel to the data electrode 20 to prevent the ultraviolet ray generated by the gas discharge from leaking to adjacent cells. The phosphorus layer 26 is spread over the surface of the lower dielectric layer 22 and the barrier ribs 24 to generate red, green and blue visible rays. The discharge space is fully filled up with an inert gas such as He, Ne, Ar, Xe, Kr, a mixture discharge gas of the above gases or an excimer gas that can generate ultraviolet ray by discharge, for gas discharge.

The discharge cell 30 of such a structure sustains the discharge in a surface discharge by the sustain electrode pair 12A 12B after being selected as an opposite discharge by the data electrode 20 and the scan electrode 12A. Accordingly, a visible ray is emitted at the discharge cell 30 by having the phosphorus 26 emit light by the ultraviolet ray that is generated upon sustain discharge. In case of this, the discharge cell

30 controls a sustain discharge period, i.e., the number of sustain discharge, in accordance with the video data to realize the gray scale required for image display. And, the color of one pixel is realized by compounding three discharge cells where each of red, green and blue phosphorus 26 is coated.

FIG. 2 illustrates an overall electrode arrangement structure of a PDP that includes the discharge cell 30 shown in FIG. 1. In FIG. 2, the discharge cell 30 is formed at every intersection of scan electrode lines Y1 to Ym, sustain electrode lines Z1 to Zm and data electrode lines X1 to Xn.

The scan electrode lines Y1 to Ym supplies scan pulses and sustain pulses to make the discharge cells 30 scanned by lines and additionally to make discharge sustained at the discharge cells 30. The sustain electrode lines Z1 to Zm commonly supply sustain pulses to make discharge sustained at the discharge cells 30 along with the scan electrode lines Y1 to Ym. The data electrode lines X1 to Xn supply data pulses, which are synchronized with the scan pulses, by lines to make a specific discharge cells selected, wherein the selected discharge cells are to have discharge sustained in accordance with the logical value of the data pulse.

A typical method in such a PDP driving method is an Address and Display Separation ADS driving method in which the PDP is driven with one frame being divided into an address period and a display period, i.e., a sustain period. In the ADS driving method, one frame is divided into a plurality of subfields corresponding to each bit of video data, and each of the subfields is divided again into a reset period, an address period and a sustain period. In such a subfield, the reset period RPD is equal to the address period APD and the sustain period SPD is given a different weight value. Accordingly, the PDP expresses the gray scale corresponding to the video data by compounding the sustain periods during which discharge is sustained, in accordance with the video data.

FIG. 3 illustrates a general driving waveform supplied to the PDP shown in FIG. 2 in a subfield SF1 among a plurality of subfields.

As in FIG. 3, in the reset period RPD, the PDP make a writing discharge generated by use of a reset pulse RP and then wall charges are removed, thereby initializing all discharge cells 30 to an off-state where the wall charges are left over. For this, a rising ramp pulse and a falling ramp pulse as reset pulse RP are supplied to the scan electrode lines Y1 to Ym, wherein the rising ramp pulse slowly increase to a peak voltage Vr on the basis of a step voltage Vs and the falling ramp pulse slowly decreases to a ground voltage 0V. A first dark discharge is generated at all the discharge cells 30 by the rising ramp pulse. And then, a second dark discharge is generated at all the discharge cells 30 by the falling ramp pulse and a bias pulse BP supplied to the sustain electrode lines Z1 to Zm. Subsequently, the wall charges formed at the scan electrode lines Y1 to Ym and the sustain electrode lines Z1 to Zm are decreased in accordance with the falling ramp pulse, thus all the discharge cells 30 are initialized to an off-state where the wall charges are left over. In this reset period RPD, the voltage of the data electrode lines X1 to Xn is fixed at the ground voltage 0V.

In the address period APD, scan pulses SP are supplied to the scan electrode lines Y1 to Ym by lines and data pulses DP are selectively supplied to the data electrode lines X1 to Xn in synchronization with the scan pulse SP. Accordingly, an address discharge is generated at the discharge cells to which the scan pulses SP and the data pulses DP are supplied, thus they become on-state where the wall charges are sufficiently formed for the next sustain discharge. But on the other hand, no address discharge is generated at the discharge cells to which no scan pulse SP and data pulse DP is supplied, thereby remaining at the off-state.

In the sustain period SPD, Y and Z sustain pulses SUSPy, SUSPz are alternately supplied to the scan electrode lines Y1 to Ym and the sustain electrode lines Z1 to Zm to make the state of the discharge cell determined in the address period APD sustained. More specifically, the discharge cells of on-state in which the wall charges are sufficiently formed in the address period APD remain at the on-state by discharge caused by the Y and Z sustain pulses SUSPy, SUSPz, and the discharge cells of off-state remain at the off-state without discharge.

In an erasure period EPD subsequent to the sustain period SPD, erasure pulses EP are supplied to the sustain electrode lines Z1 to Zm to cause an erasure discharge, thereby eliminating the wall charges existing at all the discharge cells 30.

In order to supply such driving waveforms to the PDP shown in FIG. 2, a driving device is installed at the rear surface of a heat proof plate 64 located at the side of the rear surface of the PDP 40 as shown in FIGS. 4 and 5.

A PDP module shown in FIGS. 4 and 5 includes a Y driving board 45 to drive the scan electrode lines Y1 to Ym; a Z sustainer board 48 to drive the sustain electrode lines Z1 to Zm; a data driver board 50 to drive the data electrode lines X1 to Xm; a control board 42 to control the Y driving board 45, the Z sustainer board 48 and the data driver board 50; and a power source board (not shown) to supply power to each of the boards 42, 45, 48 and 50.

The Y driving board 45 includes a scan driver board 44 to generate reset pulses RP and scan pulses SP shown in FIG. 3, and a Y sustainer board 46 to generate the Y sustain pulses SUSPy. The scan driver board 44 supplies the scan pulse SP to the scan electrode lines Y1 to Ym of the PDP 40 through a Y conductive path 51. The Y sustainer board 46 supplies the Y sustain pulse SUSPy to the scan electrode lines Y1 to Ym through the scan driver board 44 and the Y conductive path 51.

The Z sustainer board 48 generates the bias pulse BP and the Z sustain pulse SUSz shown in FIG. 3 and supplies the generated pulse to the sustain electrode lines Z1 to Zm of PDP 40 through the Z conductive path 52.

The data driver board 50 generates the data pulse DP shown in FIG. 3 and supplies the generated pulse to the data electrode lines X1 to Xn of the PDP 40 through the X conductive path 54.

The control board 42 generates X, Y, Z timing control signals. And the control board 42 supplies the Y timing control signal to the Y driving board 45 through a first conductive path 56, the Z timing control signal to the Z sustainer board 48 through a second conductive path 58, and the X timing control signal to the data driver board 50 through a third conductive path 60.

At this moment, each conductive path is any one of a flexible flat cable or a flexible printed cable.

When driving the PDP module with such a composition, a current path in the sustain period is as follows. Firstly, when the Y sustain pulse SUSPy is supplied to the scan electrode lines Y1 to Ym in the Y driving board 45, a first current path is "Y driving board 45→scan electrode line Y1 to Ym→panel capacitor→sustain electrode line Z1 to Zm→Z sustainer board 48→heat proof plate 64→Y driving board 45". And when the Z sustain pulse SUSPz is supplied to the sustain electrode lines Z1 to Zm in the Z sustainer board 48, a second current path is "Z sustainer board 48→sustain electrode line Z1 to Zm→panel capacitor→scan electrode line Y1 to Ym→Y driving board 45→heat proof plate 64→Z sustainer board 48".

However, the PDP module shown in FIGS. 4 and 5 is divided into the Y sustainer board 46 and the Z sustainer board 48, which perform similar functions to each other in the same driving period to be installed, thus its power consumption increases as well as a lot of circuit parts such as switching devices are required. Accordingly, the PDP module of prior art has a problem that its composition is complicated and its manufacturing cost is high. In order to solve such a problem, a PDP module-Korea patent application laid open No. 2003-0023387-as shown in FIG. 6 has been proposed.

FIG. 6 is a diagram representing a PDP module where Y and Z sustainer boards of prior art are integrated. FIG. 7 is a diagram representing the sectional structure of the PDP module shown in FIG. 6.

The PDP module shown in FIGS. 6 and 7 includes a PDP 70; a heat proof plate 86 installed at the rear surface for the PDP 70; a Y-Z integrated board 100, a data driver board 80 and a control board 72 installed at the rear surface of the heat proof plate 86; and a power source board (not shown) that supplies power to those boards 100, 80, 72.

The PDP 70 has a structure where an upper plate 90 and a lower plate 92 are bonded to form a gas discharge space. Herein, the scan electrode lines Y1 to Ym and the sustain electrode lines Z1 to Zm are formed in parallel in the upper plate 90 as shown in FIG. 2, and the data electrode lines X1 to Xn are formed in the lower plate 92. Further, a Y pad area 94 is provided at one side of the upper plate 90 to form Y pads (not shown) connected to the scan electrode lines, and a Z pad area 96 is provided at the other side to form Z pads (not shown) connected to the sustain electrode lines (not shown). And, an X pad area (not shown) is provided at one side of the lower plate 92 to form X pads (not shown) connected to the data lines. The upper plate 90 and the lower plate 92 is bonded to have the Y pad area 94 and the Z pad area 96 and the X pad area (not shown).

The heat proof plate 86 enables the heat generated at the PDP 70 to be easily emitted to the outside. For this, the heat proof plate 86 is installed to overlap the rear surface of the PDP 70 on the whole.

The control board 72 generates X, Y, Z timing control signals. And the control board 72 supplies the Y and Z timing control signal to the Y-Z integrated board 100 through a first conductive path 76, and the X timing control signal to the data driver board 80 through a second conductive path 78.

The data driver board 80 generates data pulses DP, as shown in FIG. 3, by use of the X timing control signal from the control board 72 and supplies the generated pulse to the data electrode lines of the PDP 70 through the X conductive path 88. Herein, the X conductive path 88 is connected to the data diver board 80 and the X pad area (not shown) which is provided at PDP 70.

The Y-Z integrated board 100 includes a scan driver board 73, a Y-Z sustainer board 74 and a connector 75 to connect the two boards 73, 74 with each other.

The scan driver board 73, as shown in FIG. 3, generates reset pulses RP which are to be supplied to the scan electrode lines in the reset period APD and scan pulses SP which are to be supplied in the address period APD by use of the Y timing control signal from the control board 72. And, the scan driver board 73 supplies the reset pulse RP and the scan pulse SP to the scan electrode lines of the PDP 70 through the Y conductive path 82.

Herein, the Y conductive path 82 is connected to the scan driver board 73 and the Y pad area 94 of the PDP 70, as shown in FIG. 7.

The Y-Z sustainer board 74, as shown in FIG. 3, generates Y sustain pulses SUSPy that are to be supplied to the scan electrode lines and Z sustain pulses SUSPz that are to be supplied to the sustain electrode lines in the sustain period SPD by use of the Y and Z timing control signal from the control board 72, wherein the Y sustain pulse SUSPy or the Z sustain pulse SUSPz is alternately supplied. And, the Y-Z sustainer board 74, as shown in FIG. 3, generates bias pulses BP that are to be supplied to the sustain electrode lines in the reset period RPD and the address period APD. For this, the Y-Z sustainer board 100 includes a Y sustain circuit (not shown) to generate the Y sustain pulse SUSPy, and a Z sustain circuit (not shown) to generate the bias pulse BP and the Z sustain pulse SUSPz. The Y-Z sustainer board 74 supplies the Y sustain pulse SUSPy to the scan electrode lines of the PDP 70 through a path of "a connector 75→a scan driver board 73→the Y conductive path 82". And the Y-Z sustainer board 74 supplies the bias pulse BP and the Z sustain pulse SUSPz to the sustain electrode lines of the PDP 70 through a Z conductive path 84.

Herein, the Z conductive path 84, as shown in FIG. 7, is connected to the Y-Z sustainer board 74 and the Z pad area 96 of the PDP 70.

In this way, the Y conductive path 82 is connected to the scan driver board 73 and the Z conductive path 84 is connected to the Y-Z sustainer board 74. Herein, the Y conductive path 82 is connected to the front surface(on the basis of PDP 70) or the rear surface of the scan driver board 73, and the Z conductive path 82 is connected to the front surface or the rear surface of the Y-Z sustainer board 74.

In case that the PDP module with such a configuration is driven, the current path is as follows in the sustain period SPD. Firstly, when the Y-Z sustainer board 74 supplies the Y sustain pulse SUSPy to the scan electrode lines of the PDP 70, a first current path is "Y-Z sustainer board 74→connector→scan driver board 73→Y conductive path 82→scan electrode line→panel capacitor→sustain electrode line→Z conductive path 84→Y-Z sustainer board 74". And, when the Y-Z sustainer board 74 supplies the Z sustain pulse SUSPz to the sustain electrode lines of the PDP 70, a second current path is "Y-Z sustainer board 74→Z conductive path 84→sustain electrode line→panel capacitor→scan electrode line→Y conductive path 82→scan driver board 73→connector 75→Y-Z sustainer board 74"

At this moment, each conductive path is any one of a flexible flat cable or a flexible printed cable.

In such a PDP module, the Z conductive path 84 might easily give electromagnetic interference EMI to the control board 72 and the power source board (not shown) or be affected by it. Due to this, it is possible that the inductance of the Z conductive path 84 increases. Accordingly, when the Y-Z sustainer board 74 and sustain electrode lines are connected by use of that long Z conductive path 84, an electromagnetic shielding protective film should be used to reduce noise or inductance. But, there is a problem that such a protective film can be easily torn off in an assembly process.

SUMMARY OF THE INVENTION

Accordingly, it is an object of the present invention to provide a plasma display panel and a module thereof that is adaptive for reducing inductance as well as simplifying an assembly process of an integrated sustainer board.

In order to achieve these and other objects of the invention, a plasma display panel module according to an aspect of the present invention includes a plasma display panel having scan electrode lines, sustain electrode lines and data electrode lines formed at a display area, a common electrode line formed at a non-display area to be commonly connected to the sustain electrode lines, a first pad formed at the non-display area to be connected with the scan electrode lines, and a second pad formed at a non-display area of any one of an upper plate or a lower plate to be connected to the common line; an integrated driving board to drive the scan electrode lines and the sustain electrode lines, a first conductive path connected between the integrated driving boards and the first pad; and a second conductive path connected between the integrated driving board and the second pad.

In the plasma display panel module, the second pad is formed to be linearly connected to any one of the upper side or lower side of the integrated driving board.

In the plasma display panel module, the common electrode line includes a first common electrode line formed at one side of the plasma display panel to be commonly connected to the sustain electrode lines; and a second common electrode line formed at the upper side of the plasma display panel to be connected to the one side of the first common electrode line.

In the plasma display panel module, the first and second common electrode lines are formed at the same substrate.

In the plasma display panel module, the first and second common electrode lines are not formed at the same substrate.

In the plasma display panel module, the plasma display panel further includes a connecting part to connect the first common electrode line with the second common electrode line.

In the plasma display panel module, the connecting part is any one of a flexible flat cable or a flexible printed cable.

In the plasma display panel module, the first and second pads are formed at the same substrate.

In the plasma display panel module, the first and second pads are not formed at the same substrate.

In the plasma display panel module, the first and second conductive paths are any one of a flexible flat cable or a flexible printed cable.

In the plasma display panel module, the integrated driving board includes a scan driver board to generate a scan pulse which is to be supplied to the scan electrode lines; an integrated sustainer board to generate a first sustain pulse which is to be supplied to the san electrode lines and a second sustain pulse which is to be supplied to the sustain electrode lines; and a connector to connect the scan driver board with the integrated sustainer board.

The plasma display panel module further includes a heat proof plate to emit heat from the plasma display panel; a data driver board to generate a data pulse which is to be supplied to the data electrode lines; a control board to supply a corresponding signal to each of the scan driver board, the integrated board and the data driver board; and a power source board to supply required power to each of the boards.

A plasma display panel according to another aspect of the present invention includes a plurality of scan electrode lines, a plurality of sustain electrode lines and a plurality of data electrode lines formed at a display area; a common electrode line formed at a non-display area to be commonly connected to the sustain electrode lines; a first pad formed at the non-display area to be connected to the scan electrode lines; and a second pad formed at the non-display area of any one of the upper side or the lower side of the panel to be connected to the common electrode line.

The common electrode line includes a first common electrode line formed at one side of the plasma display panel to be commonly connected to the sustain electrode lines; and a second common electrode line formed at the upper side of the plasma display panel to be connected to the one side of the first common electrode line.

The first and second common electrode lines are formed at the same substrate.

The first and second common electrode lines are not formed at the same substrate.

The plasma display panel further includes a connecting part to connect the first common electrode line with the second common electrode line.

The connecting part is any one of a flexible flat cable or a flexible printed cable.

The first and second pads are formed at the same substrate.

The first and second pads are not formed at the same substrate.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 8 to 16, embodiments of the present invention will be explained as follows.

Figure 8:
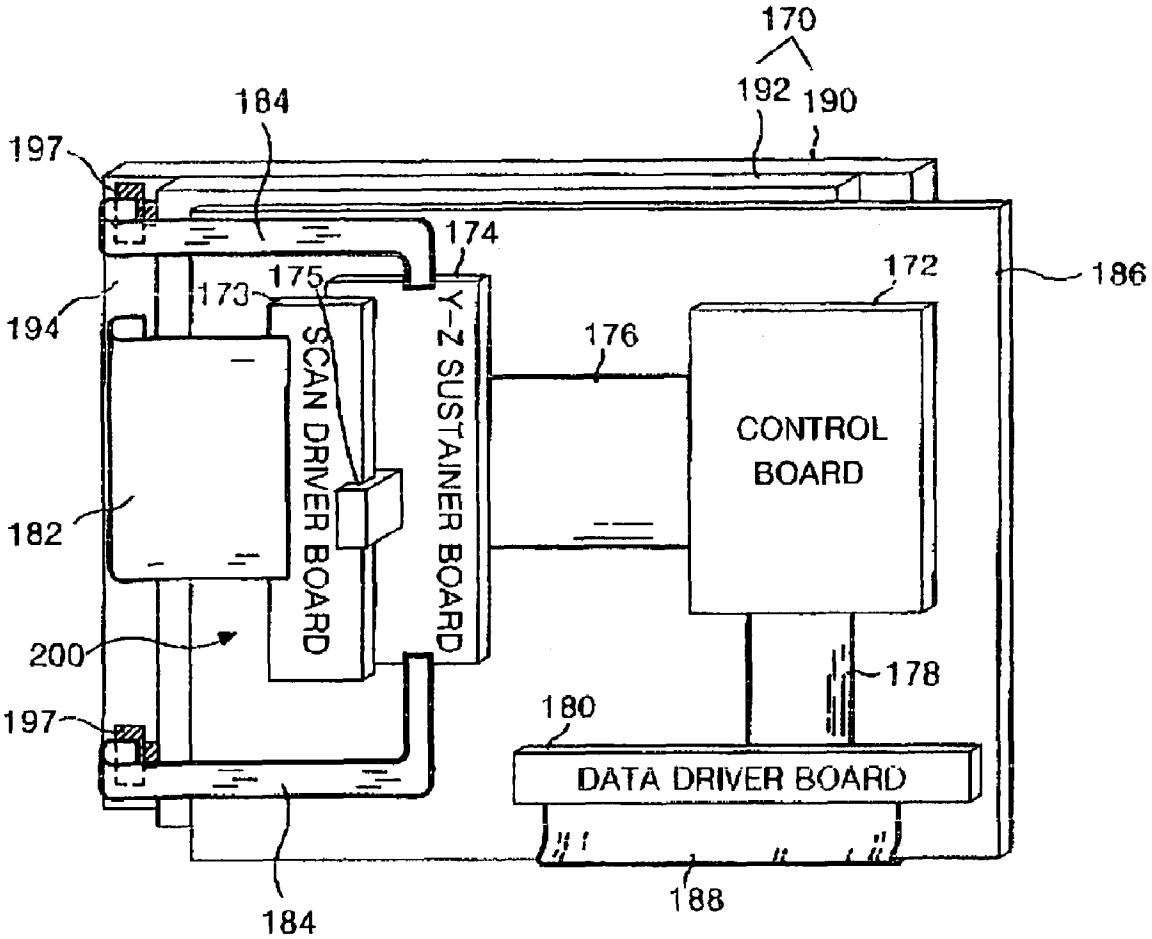
FIG. 8 is a diagram illustrating the rear surface structure of a plasma display panel module according to a first embodiment of the present invention.
Figure 9:
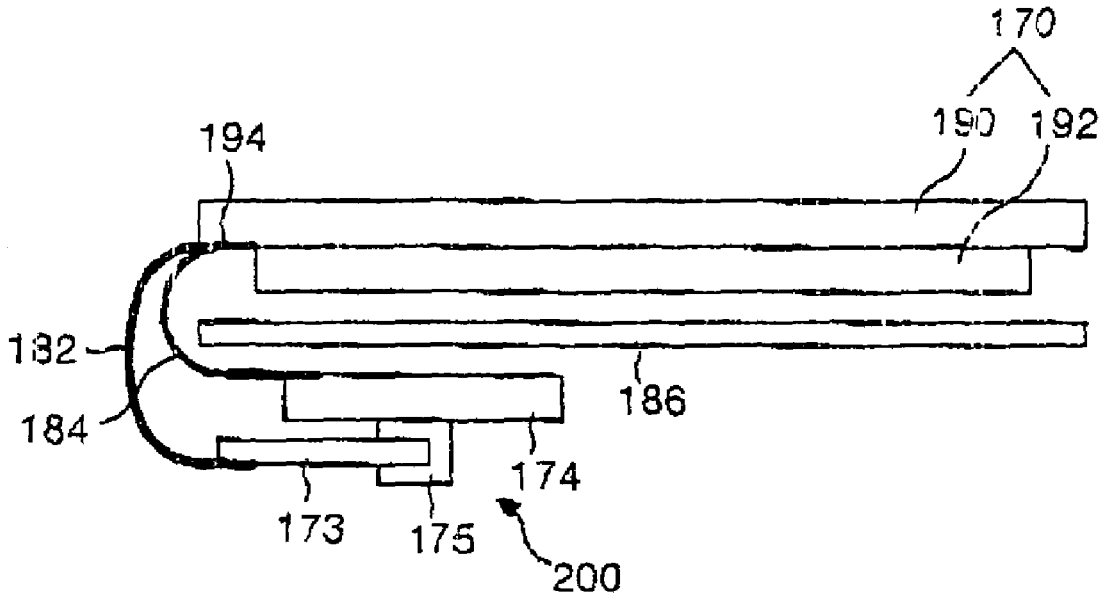
FIG. 9 is a sectional diagram of the plasma display panel module shown in FIG. 8.
Figure 10:
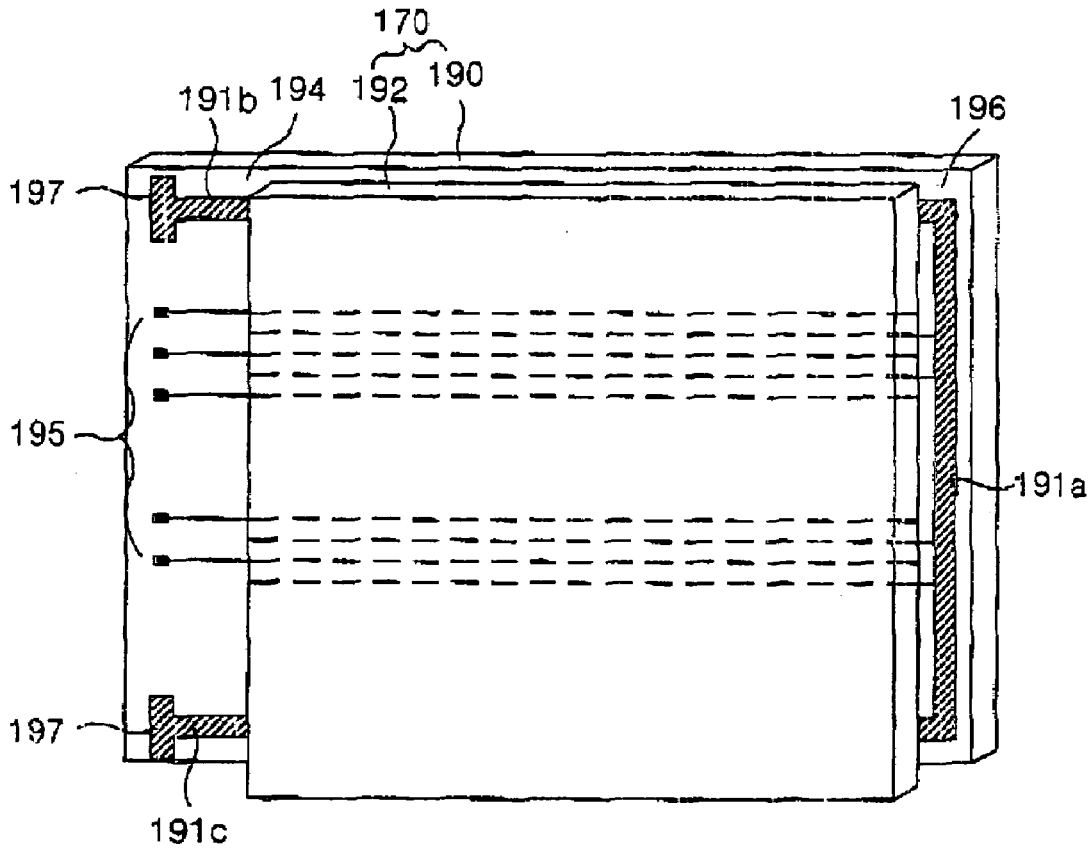
FIG. 10 is a diagram representing a plasma display panel in the plasma display panel module shown in FIG. 8, in detail.

FIG. 8 is a diagram representing a PDP module according to a first embodiment of the present invention. FIG. 9 is a sectional structure of the PDP module shown in FIG. 8. FIG. 10 is a diagram representing a PDP shown in FIG. 8.

Referring to FIGS. 8 and 9, a PDP module includes a PDP 170; a heat proof plate 186 installed at the rear surface of the PDP 170; and a Y-Z integrated board 200, a data driver board 180, a control board 172, which were installed at the rear surface of the heat proof plate 186, and a power source board (not shown) that supplies power to each of the boards 200, 180, 172.

The PDP 170, as shown in FIG. 10, has a structure that an upper plate 190 and a lower plate 192 are bonded to form a gas discharge space. Herein, scan electrode lines and sustain electrode lines are formed in parallel in the upper plate 190, and data electrode lines are formed in the lower plate 192. Further, a second area 196 is provided at a non-display area of one side of the upper plate 190 so that a first common electrode line 191A is formed to be commonly connected to the sustain electrode lines. A second common electrode line 191B is formed to be connected to one side of the first common electrode line 191A at the non-display area of the upper side of the upper plate 190, a third common electrode line 191C is formed to be connected to the other side of the first common electrode line 191A at the non-display area of the lower side of the upper plate 190. And, a first area 194 is provided in the non-display area of the other side of the upper plate 190. In the first area 194, a Y pad 195 is formed to be connected to the scan electrode lines and a Z pad 197 is formed to be connected to one side of the second and third common electrode line 191B, 191C. And, an X pad area (not shown) is provided at one side of the lower plate 192 and an X pad (not shown) is formed to be connected to the data lines. The upper plate 190 and lower plate 192 are bonded to have the first area 194 and the second area 196 and the X pad area (not shown) exposed.

The heat proof plate 186 enables the heat generated at the PDP 170 to be easily emitted to the outside. For this, the heat proof plate 186 is installed to overlap the rear surface of the PDP 170 on the whole.

The control board 172 generates X, Y, Z timing control signals. And the control board 172 supplies the Y and Z timing control signal to the Y-Z integrated board 200 through a first conductive path 176, and the X timing control signal to the data driver board 180 through a second conductive path 178.

Figure 1:
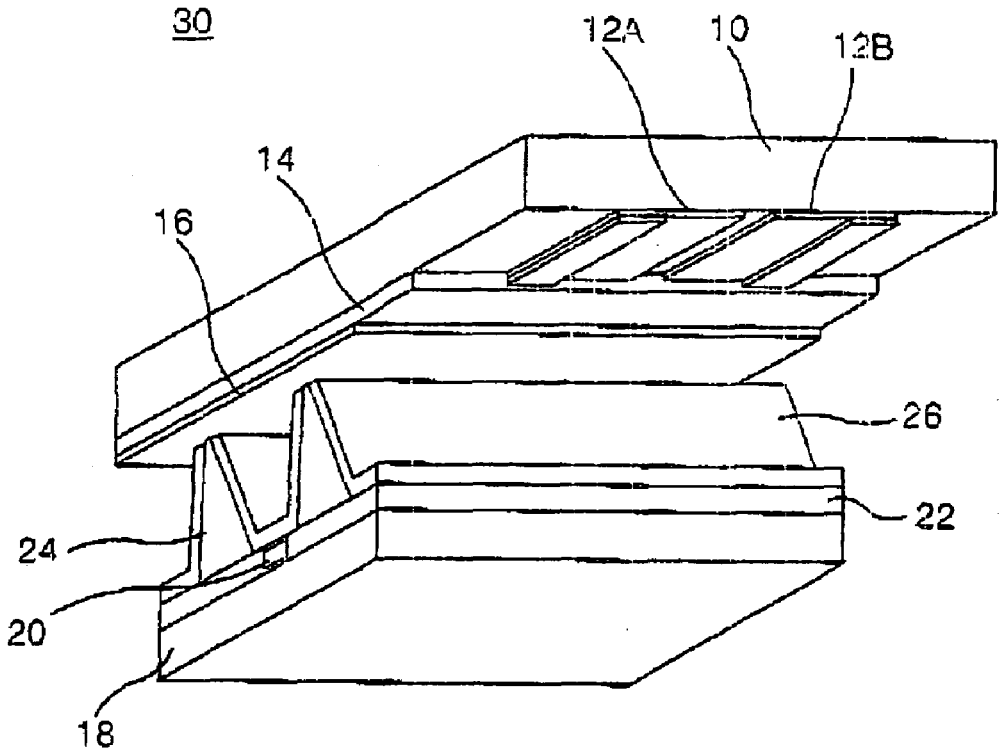
FIG. 1 RELATED ART
FIG. 1 is a perspective diagram illustrating a discharge cell of a three AC type plasma display panel.
Figure 2:
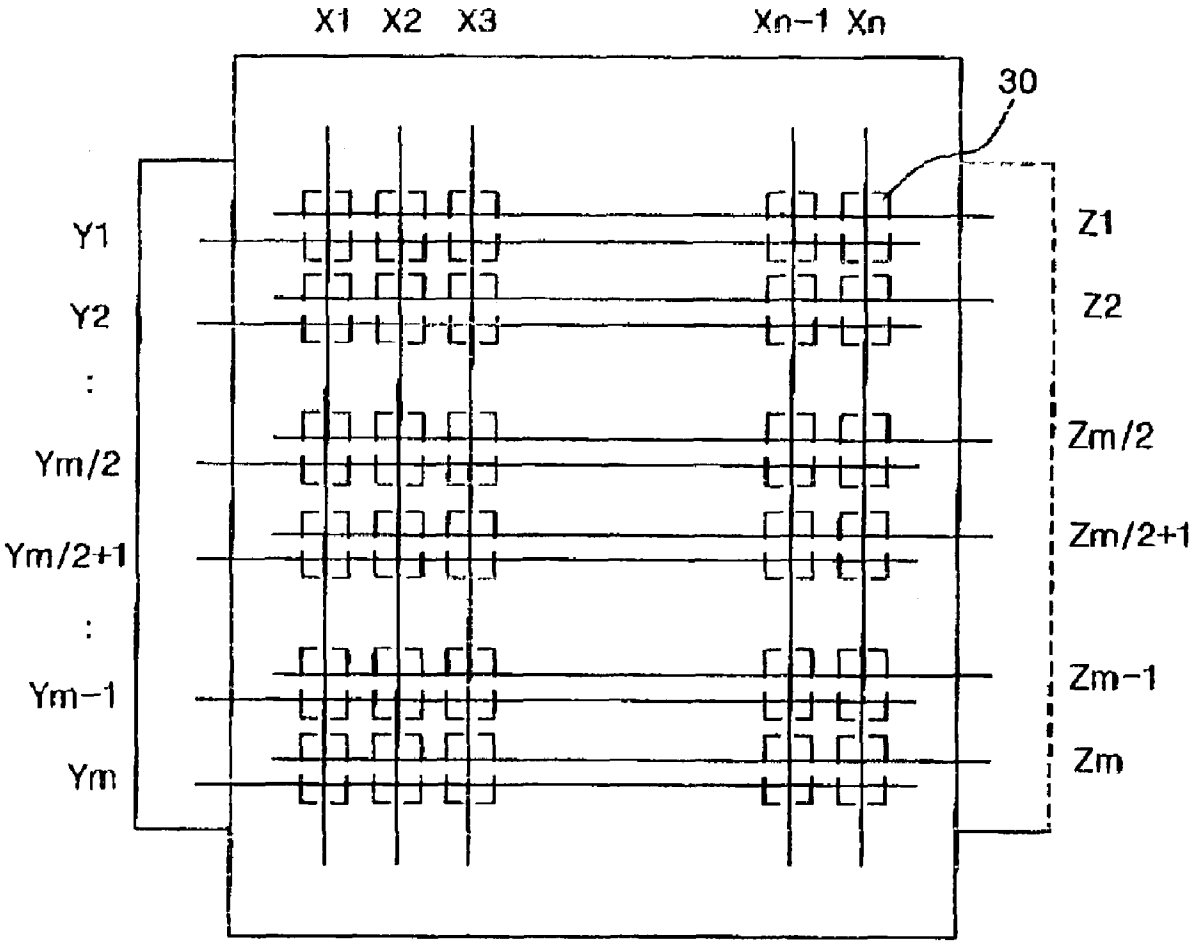
FIG. 2 RELATED ART
FIG. 2 is an arrangement plan of the whole electrodes of a general plasma display panel.
Figure 3:
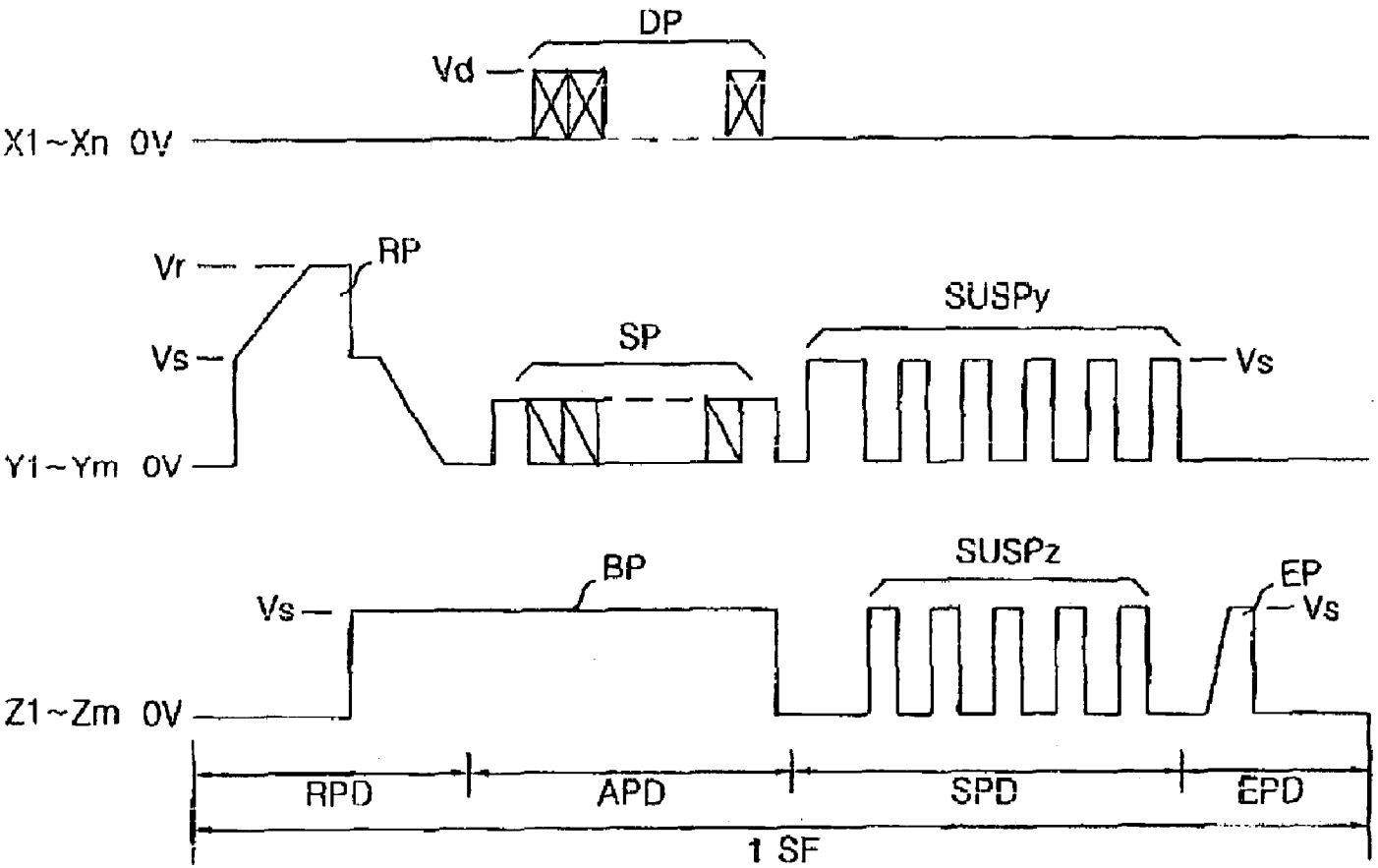
FIG. 3 RELATED ART
FIG. 3 is a driving waveform of a plasma display panel shown in FIG. 2.
Figure 4:
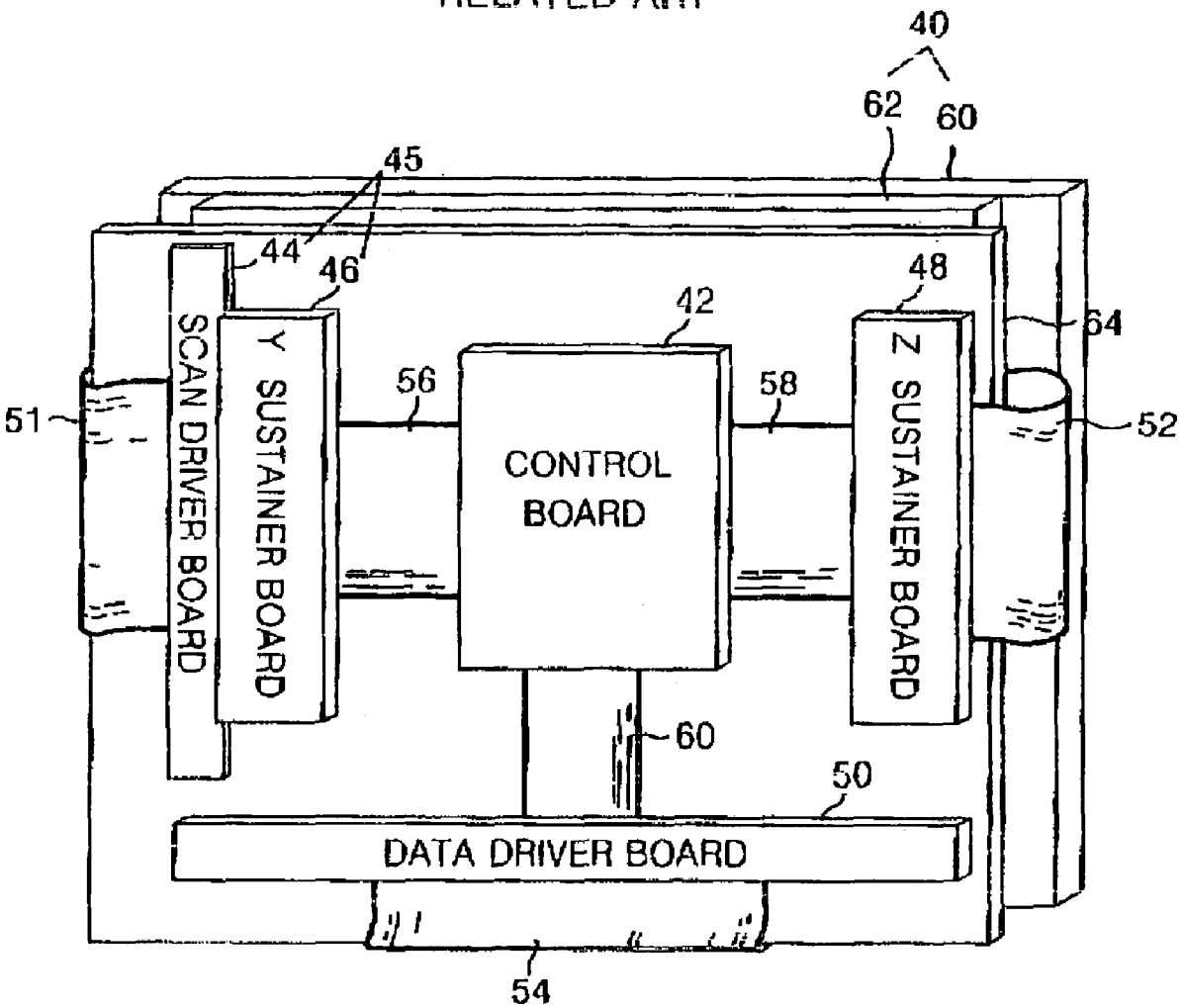
FIG. 4 RELATED ART
FIG. 4 is a diagram illustrating the rear surface structure of a prior art plasma display panel.
Figure 5:
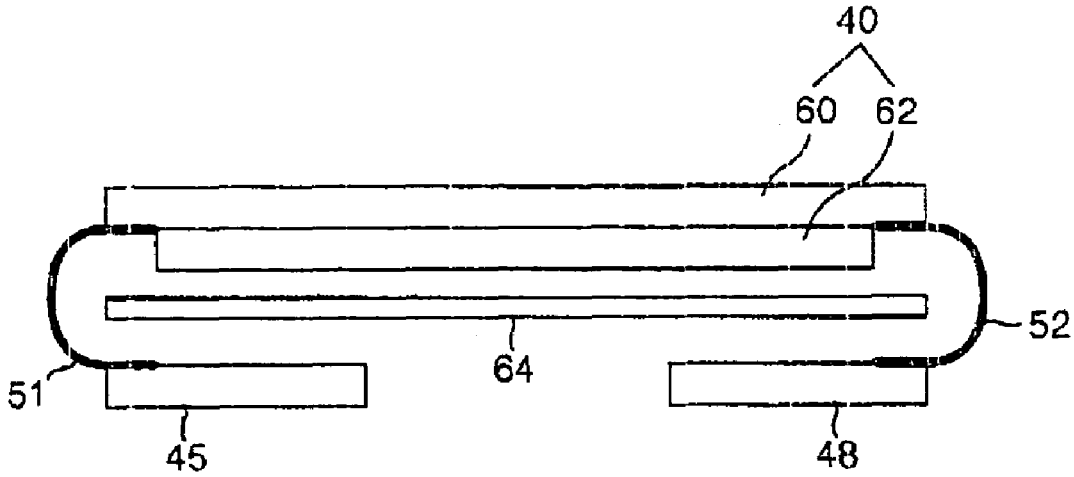
FIG.5 RELATED ART
FIG. 5 is a sectional diagram of a plasma display panel module shown in FIG. 4.
Figure 6:
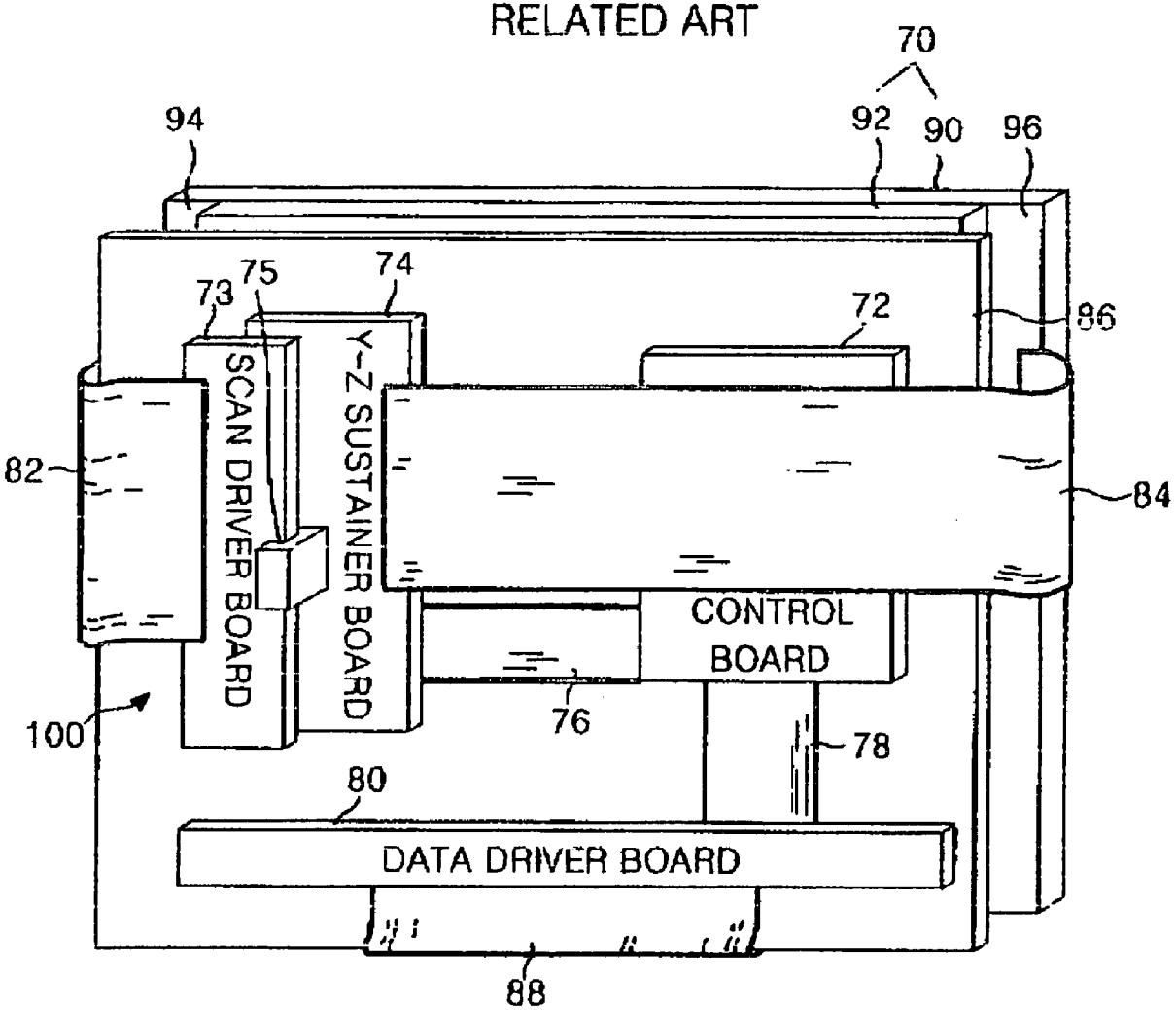
FIG. 6 RELATED ART
FIG. 6 is a diagram illustrating the rear surface structure of a plasma display panel module where prior art Y and Z sustainer boards are integrated.
Figure 7:
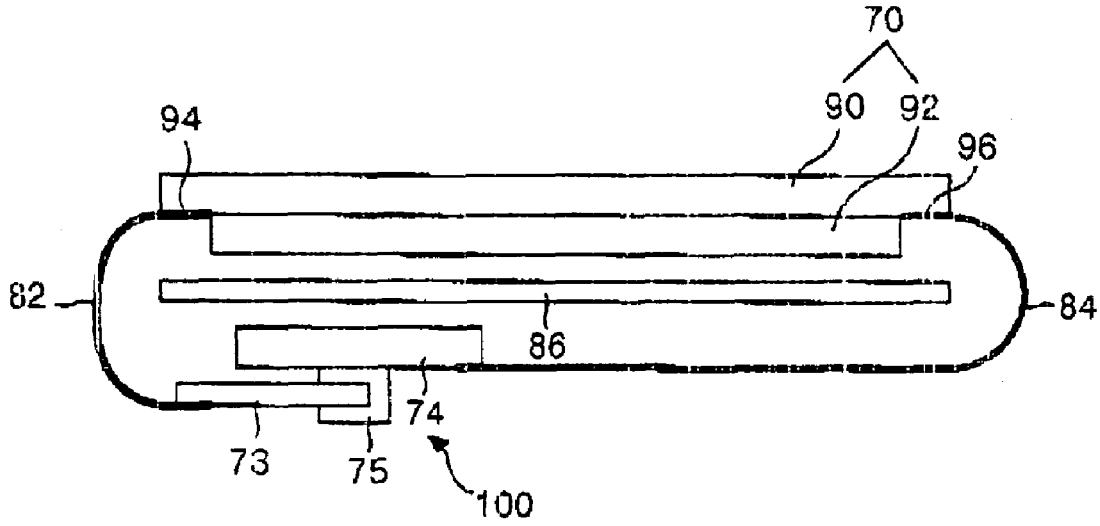
FIG. 7 RELATED ART
FIG. 7 is a sectional diagram of the plasma display panel module shown in FIG. 6.

The data driver board 180 generates data pulses DP, as shown in FIG. 3, by use of the X timing control signal from the control board 172 and supplies the generated pulse to the data electrode lines of the PDP 170 through the X conductive path 188. Herein, the X conductive path 188 is connected to the data diver board 180 and the X pad area (not shown) which is provided at PDP 170.

The Y-Z integrated board 200 includes a scan driver board 173, a Y-Z sustainer board 174 and a connector 175 to connect the two boards 173, 174 with each other.

The scan driver board 173, as shown in FIG. 3, generates reset pulses RP which are to be supplied to the scan electrode lines in the reset period APD and scan pulses SP which are to be supplied in the address period APD by use of the Y timing control signal from the control board 172. And, the scan driver board 173 supplies the reset pulse RP and the scan pulse SP to the scan electrode lines of the PDP 170 through the Y conductive path 182.

Herein, the Y conductive path 182 is connected to the scan driver board 173 and the first area 194 of the upper plate 190 of the PDP 170, as shown in FIG. 10.

The Y-Z sustainer board 174, as shown in FIG. 3, generates Y sustain pulses SUSPy that are to be supplied to the scan electrode lines and Z sustain pulses SUSPz that are to be supplied to the sustain electrode lines in the sustain period SPD by use of the Y and Z timing control signal from the control board 172, wherein the Y sustain pulse SUSPy or the Z sustain pulse SUSPz is alternately supplied. And, the Y-Z sustainer board 174, as shown in FIG. 3, generates bias pulses BP that are to be supplied to the sustain electrode lines in the reset period RPD and the address period APD. For this, the Y-Z sustainer board 174 includes a Y sustain circuit (not shown) to generate the Y sustain pulse SUSPy, and a Z sustain circuit (not shown) to generate the bias pulse BP and the Z sustain pulse SUSPz. The Y-Z sustainer board 174 supplies the Y sustain pulse SUSPy to the scan electrode lines through the Y pad 195 provided at the first area 194 of the upper plate 190 of the PDP 170 via a path of "a connector 175→a scan driver board 173→the Y conductive path 182". And the Y-Z sustainer board 174 supplies the bias pulse BP and the Z sustain pulse SUSPz to the sustain electrode lines by supplying it to the first to third common electrode lines 191A, 191B, 191C which are commonly connected to the sustain electrode lines through the Z pad 197 provided at the first area 194 of the upper plate 190 of the PDP 170 via a Z conductive path 184.

Herein, the Z conductive path 184, as shown in FIG. 10, is connected to the Y-Z sustainer board 174 and the first area 194 of the upper plate 190 of the PDP 70.

In this way, the Y conductive path 182 is connected to the scan driver board 173 and the Z conductive path 184 is connected to the Y-Z sustainer board 174. Herein, the Y conductive path 182 is connected to the front surface (on the basis of PDP 170) or the rear surface of the scan driver board 173, and the Z conductive path 182 is connected to the front surface or the rear surface of the Y-Z sustainer board 174.

In case that the PDP module with such a configuration is driven, the current path is as follows in the sustain period SPD. Firstly, when the Y-Z sustainer board 174 supplies the Y sustain pulse SUSPy to the scan electrode lines of the PDP 170, a first current path is "Y-Z sustainer board 174→connector 175→scan driver board 173→Y conductive path 182→scan electrode line→panel capacitor→sustain electrode line→the first common electrode line 191A→the second and third common electrode lines 191B, 191C→Z conductive path 184→Y-Z sustainer board 174". And, when the Y-Z sustainer board 174 supplies the Z sustain pulse SUSPz to the sustain electrode lines of the PDP 170, a second current path is "Y-Z sustainer board 174→Z conductive path 184→the second and third common electrode lines 191B, 191C→the first common electrode line 191A→sustain electrode line→panel capacitor→scan electrode line→Y conductive path 182→scan driver board 173→connector 175→Y-Z sustainer board 174"

At this moment, each conductive path is any one of a flexible flat cable or a flexible printed cable.

In the PDP module, the first to third common electrode lines 191A, 191B, 191C commonly connected to the sustain electrode lines can have an effect that electromagnetic interference EMI with the control board 172 and the power board (not shown) is shielded by the heat proof plate 186. Also, the Y conductive path 182 and the Z conductive path 184 are connected to one side of the PDP 170, thereby simplifying its assembly process. However, even though the length of the Z conductive path 184 used when connecting the Z pad 197 with the Y-Z sustainer board 174 is shortened, it has a certain length, thus the inductance in the path increases to reduce energy recovery efficiency. Accordingly, the PDP module is limited as shown in FIG. 11.

Figure 11:
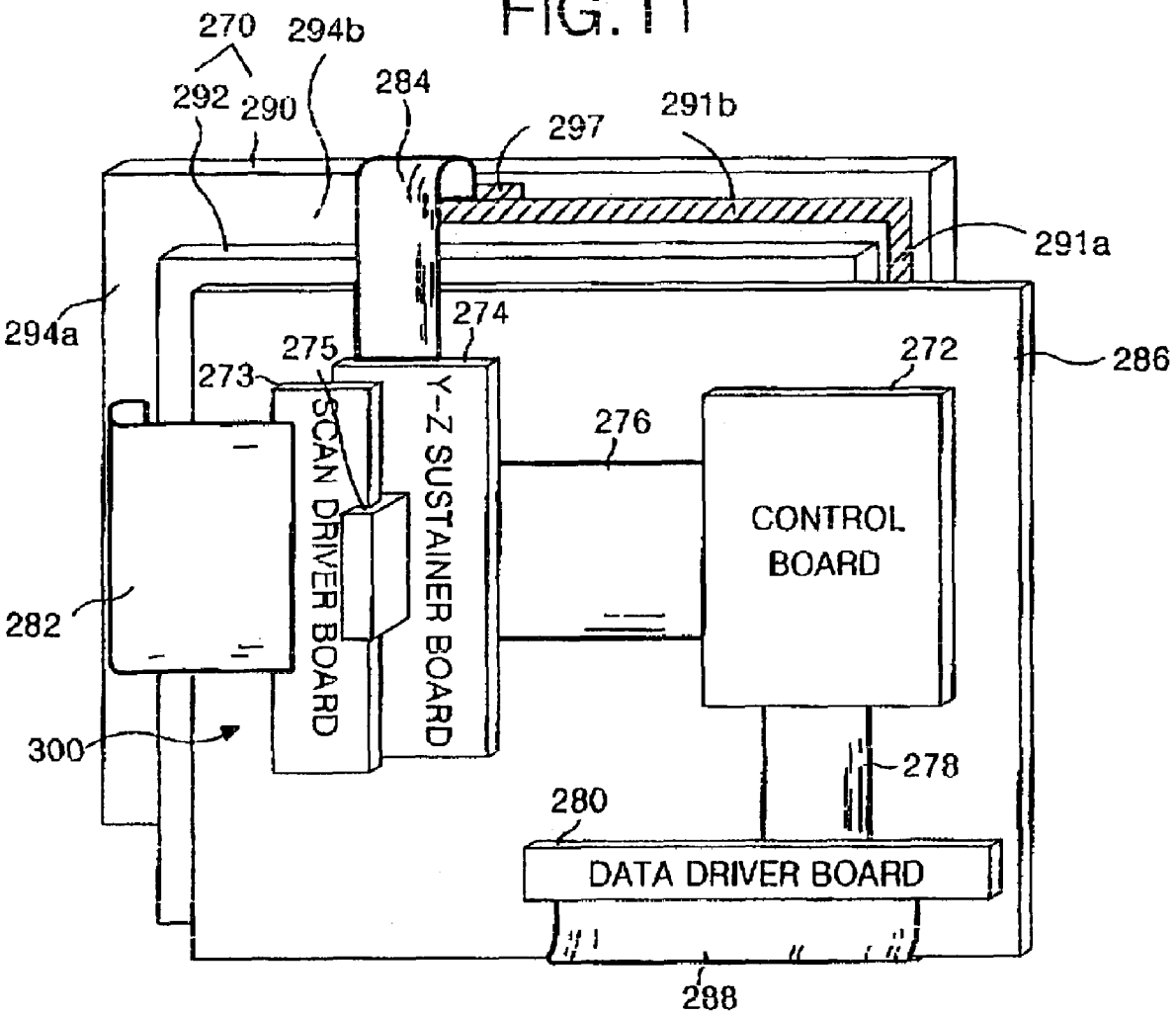
FIG. 11 is a diagram illustrating the rear surface structure of a plasma display panel module according to a second embodiment of the present invention.
Figure 12:
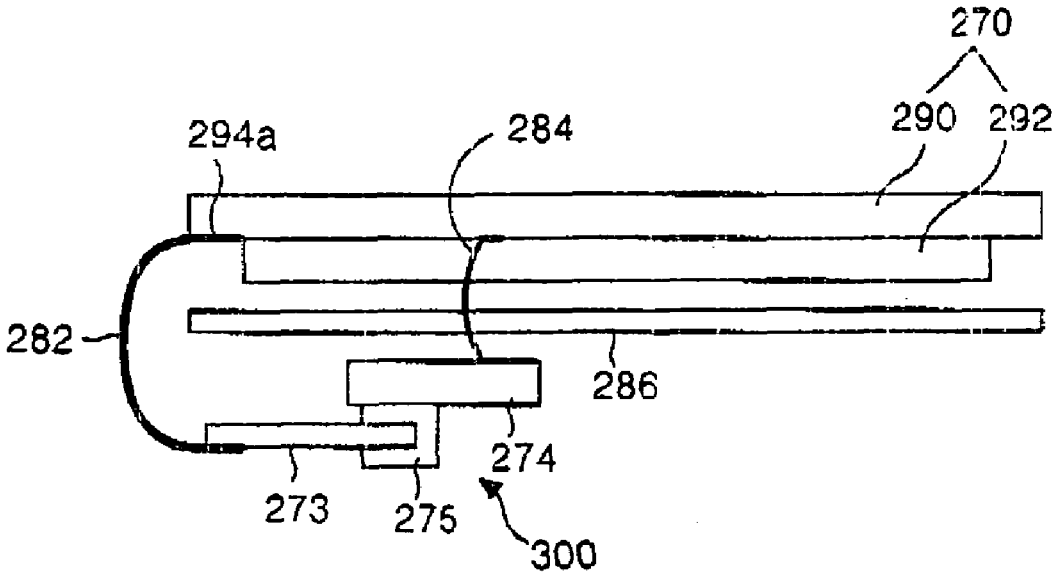
FIG. 12 is a sectional diagram of the plasma display panel module shown in FIG. 11.
Figure 13:
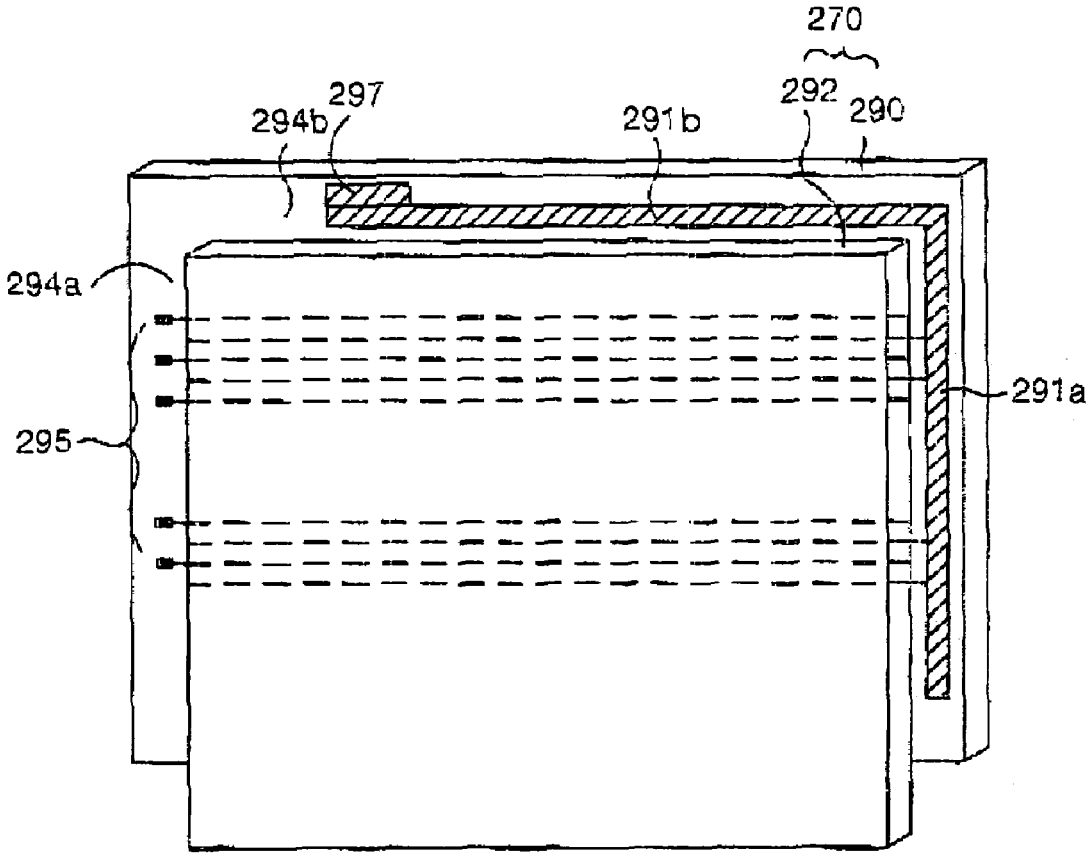
FIG. 13 is a diagram representing a plasma display panel in the plasma display panel module shown in FIG. 11, in detail.

FIG. 11 is a diagram representing a PDP module according to a second embodiment of the present invention. FIG. 12 is a sectional structure of the PDP module shown in FIG. 11. FIG. 13 is a diagram representing a PDP shown in FIG. 11.

Referring to FIGS. 11 and 12, a PDP module includes a PDP 270; a heat proof plate 286 installed at the rear surface of the PDP 270; and a Y-Z integrated board 300, a data driver board 280, a control board 272, which were installed at the rear surface of the heat proof plate 286, and a power source board (not shown) that supplies power to each of the boards 300, 280, 272.

The PDP 270, as shown in FIG. 12, has a structure that an upper plate 290 and a lower plate 292 are bonded to form a gas discharge space. Herein, scan electrode lines and sustain electrode lines are formed in parallel in the upper plate 290, and data electrode lines are formed in the lower plate 292.

Further, a common area 296 is provided at a non-display area of one side of the upper plate 290 so that a first common electrode line 291A is formed to be commonly connected to the sustain electrode lines. A Z pad area 294B is provided at a non-display area of the upper side of the upper plate 290 so that a second common electrode line 291B is formed to be connected to one side of the first conimon electrode line 291A. And a Z pad 297 is formed to be connected to the second common electrode line 29 lB. Herein, the Z pad 297 is formed at the upper side of the upper plate 290, which is non-display area, to be connected to the Y-Z integrated board 300 in the shortest distance. And, a Y pad area 294A is provided in the non-display area of the other side of the upper plate 290. In the Y pad area 294A, a Y pad 295 is formed to be connected to the scan electrode lines. And, an X pad area (not shown) is provided at one side of the lower plate 292 and an X pad (not shown) is formed to be connected to the data lines. The upper plate 290 and lower plate 292 are bonded to have the Y pad area 294A, the Z pad area 294B, the common area 296 and the X pad area (not shown) exposed.

The heat proof plate 286 enables the heat generated at the PDP 270 to be easily emitted to the outside. For this, the heat proof plate 286 is installed to overlap the rear surface of the PDP 270 on the whole.

The control board 272 generates X, Y, Z timing control signals. And the control board 272 supplies the Y and Z timing control signal to the Y-Z integrated board 300 through a first conductive path 276, and the X timing control signal to the data driver board 280 thorough a second conductive path 278.

The data driver board 280 generates data pulses DP, as shown in FIG. 3, by use of the X timing control signal from the control board 272 and supplies the generated pulse to the data electrode lines of the PDP 270 through the X conductive path 288. Herein, the X conductive path 288 is connected to the data diver board 280 and the X pad area (not shown) which is provided at PDP 270.

The Y-Z integrated board 300 includes a scan driver board 273, a Y-Z sustainer board 274 and a connector 275 to connect the two boards 273, 274 with each other.

The scan driver board 273, as shown in FIG. 3, generates reset pulses RP which are to be supplied to the scan electrode lines in the reset period APD and scan pulses SP which are to be supplied in the address period APD by use of the Y timing control signal from the control board 272. And, the scan driver board 273 supplies the reset pulse RP and the scan pulse SP to the scan electrode lines of the PDP 270 through the Y conductive path 282.

Herein, the Y conductive path 282 is connected to the scan driver board 273 and the Y pad area 294A of the upper plate 290 of the PDP 270, as shown in FIG. 13.

The Y-Z sustainer board 274, as shown in FIG. 3, generates Y sustain pulses SUSPy that are to be supplied to the scan electrode lines and Z sustain pulses SUSPz that are to be supplied to the sustain electrode lines in the sustain period SPD by use of the Y and Z timing control signal from the control board 272, wherein the Y sustain pulse SUSPy or the Z sustain pulse SUSPz is alternately supplied. And, the Y-Z sustainer board 274, as shown in FIG. 3, generates bias pulses BP that are to be supplied to the sustain electrode lines in the reset period RPD and the address period APD. For this, the Y-Z sustainer board 274 includes a Y sustain circuit (not shown) to generate the Y sustain pulse SUSPy, and a Z sustain circuit (not shown) to generate the bias pulse BP and the Z sustain pulse SUSPz. The Y-Z sustainer board 274 supplies the Y sustain pulse SUSPy to the scan electrode lines through the Y pad 295 provided at the Y pad area 294A of the upper plate 290 of the PDP 270 via a path of "a connector 275→a scan driver board 273→the Y conductive path 282". And the Y-Z sustainer board 274 supplies the bias pulse BP and the Z sustain pulse SUSPz to the sustain electrode lines by supplying it to the first and second common electrode lines 291A, 291B which are commonly connected to the sustain electrode lines through the Z pad 297 provided at the Z pad area 294B of the upper side of the upper plate 290 of the PDP 170 to be connected with the Y-Z sustainer board 274 in the shortest distance, via a Z conductive path 284.

Herein, the Z conductive path 284, as shown in FIG. 13, is connected to the Y-Z sustainer board 274 and the Z pad 297 provided at the Z pad area 294B of the upper side of the upper plate 290 of the PDP 270.

In this way, the Y conductive path 282 is connected to the scan driver board 273 and the Z conductive path 284 is connected to the Y-Z sustainer board 274. Herein, the Y conductive path 282 is connected to the front surface(on the basis of PDP 270) or the rear surface of the scan driver board 273, and the Z conductive path 282 is connected to the front surface or the rear surface of the Y-Z sustainer board 274.

In case that the PDP module with such a configuration is driven, the current path is as follows in the sustain period SPD. Firstly, when the Y-Z sustainer board 274 supplies the Y sustain pulse SUSPy to the scan electrode lines of the PDP 270, a first current path is "Y-Z sustainer board 274→connector 275→scan driver board 273→Y conductive path 282→scan electrode line→panel capacitor→sustain electrode line→the first common electrode line 291A→the second common electrode lines 291B→Z conductive path 284→Y-Z sustainer board 274". And, when the Y-Z sustainer board 274 supplies the Z sustain pulse SUSPz to the sustain electrode lines of the PDP 270, a second current path is "Y-Z sustainer board 274→Z conductive path 284→the second common electrode lines 291B→the first common electrode line 291A→sustain electrode line→panel capacitor→scan electrode line→Y conductive path 282→scan driver board 273→connector 275→Y-Z sustainer board 274"

At this moment, each conductive path is any one of a flexible flat cable or a flexible printed cable.

In the PDP module, the first and second common electrode lines 291A, 2915 commonly connected to the sustain electrode lines can have an effect that electro-magnetic interference EMI with the control board 272 and the power board (not shown) is shielded by the heat proof plate 286.

Also, the Z pad 297 is formed at the Z pad area 294B of the upper side of the non-display area of the PDP upper plate 290 to be connected the Z conductive path 284 with the Y-Z sustainer board in the shortest distance, thereby the inductance decrease to increase energy recovery efficiency. In addition, the Y conductive path 282 and the Z conductive path 284 are connected in the shortest distance to enable its assembly process simplified.

On the other hand, when the second common electrode line 291B is formed at the lower side of the PDP upper plate 290, the Z pad 297 connected to the second common electrode line 291B can be formed at the lower side of the PDP upper plate 290 to be connected with the Y-Z sustainer board 274 in the shortest distance.

Figure 14:
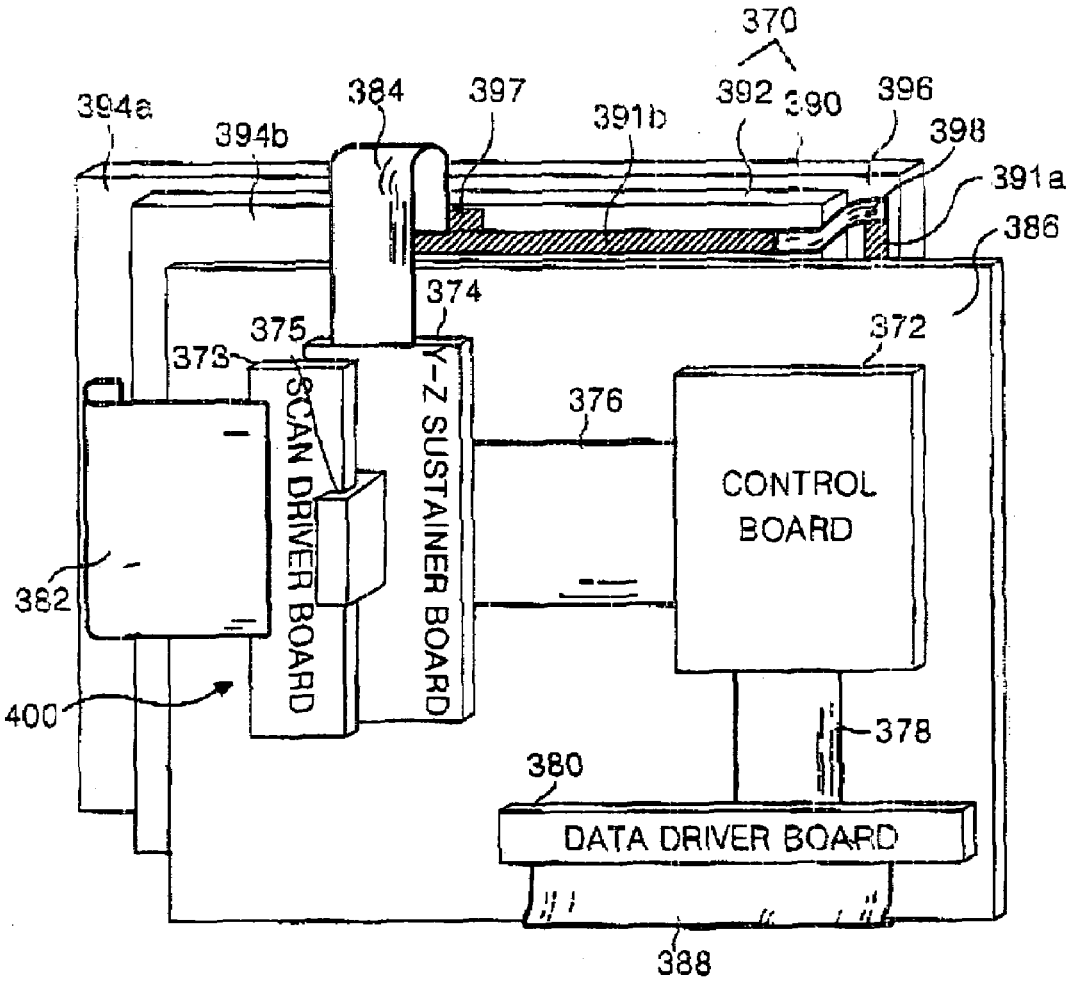
FIG. 14 is a diagram illustrating the rear surface structure of a plasma display panel module according to a third embodiment of the present invention.
Figure 15:
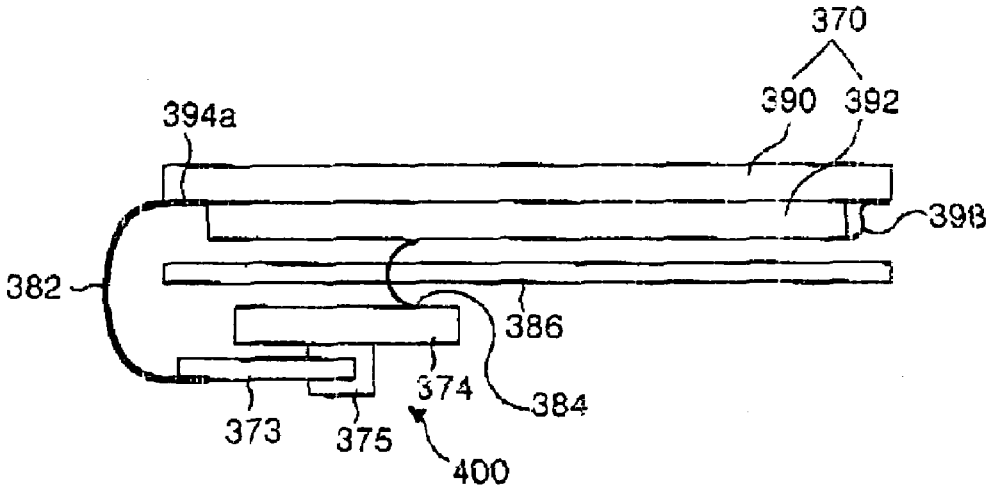
FIG. 15 is a sectional diagram of the plasma display panel module shown in FIG. 14.
Figure 16:
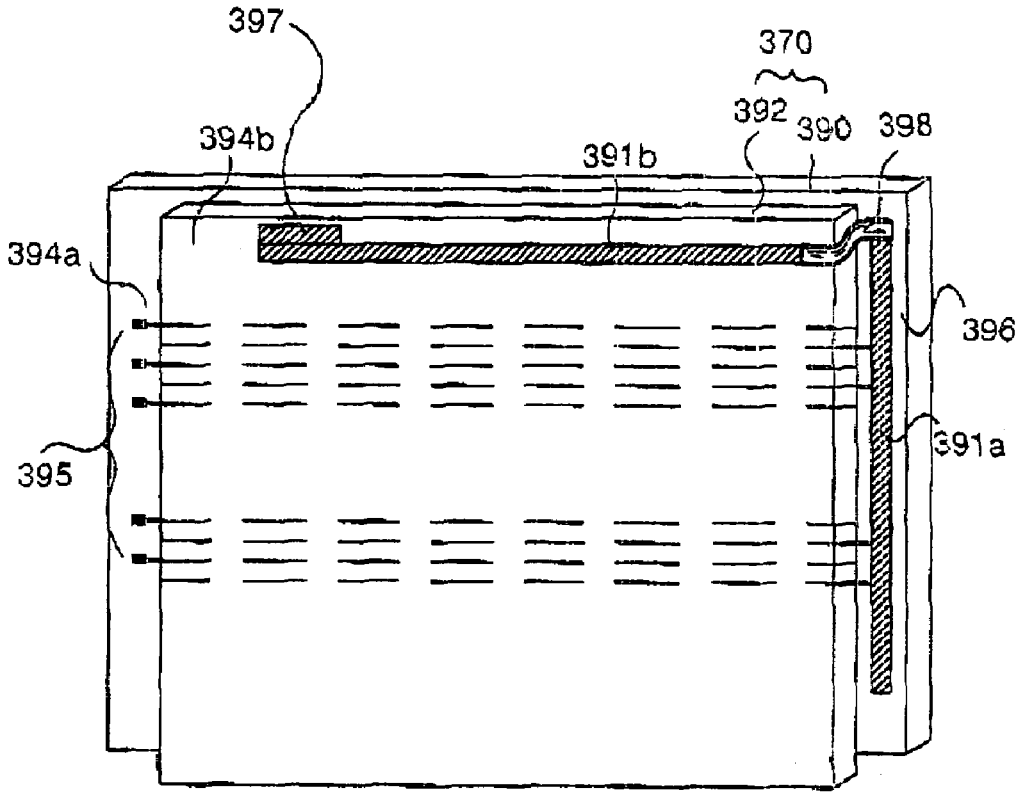
FIG. 16 is a diagram representing a plasma display panel in the plasma display panel module shown in FIG. 14, in detail.

FIG. 14 is a diagram representing a PDP module according to a third embodiment of the present invention. FIG. 15 is a sectional structure of the PDP module shown in FIG. 14. FIG. 16 is a diagram representing a PDP shown in FIG. 14.

Referring to FIGS. 14 and 15, a PDP module includes a PDP 370; a heat proof plate 386 installed at the rear surface of the PDP 370; and a Y-Z integrated board 400, a data driver board 380, a control board 372, which were installed at the rear surface of the heat proof plate 386, and a power source board (not shown) that supplies power to each of the boards 400, 380, 372.

The PDP 370, as shown in FIG. 15, has a structure that an upper plate 390 and a lower plate 392 are bonded to form a gas discharge space. Herein, scan electrode lines and sustain electrode lines are formed in parallel in the upper plate 390, and data electrode lines are formed in the lower plate 392. Further, a common area 396 is provided at a non-display area of one side of the upper plate 390 so that a first common electrode line 391A is formed to be commonly connected to the sustain electrode lines. A second common electrode line 391B is formed at the non-display area of the upper side of the lower plate 392. In other words, according to the third embodiment of the present invention, the first common electrode line 391A is formed at the upper plate 390 of the PDP and the second common electrode line 391B is formed at the lower plate 392 of the PDP. And, a Y pad area 394A is provided in the non-display area of the other side of the upper plate 390. In the Y pad area 394A, a Y pad 395 is formed to be connected to the scan electrode lines.

A Z pad area 394B is provided at the non-display area of the upper side of the upper plate 390, and a second common electrode line 391B connected with one side of the first common electrode line 391A is formed and a Z pad 397 connected to the second common electrode line 391B is formed. Herein, the Z pad 337 is formed at the upper side of the lower plate 392, which is a non-display area and is connected with the Y-Z integrated board 400 in the shortest distance. And, an X pad area (not shown) is provided at one side of the lower plate 392 and an X pad (not shown) is formed to be connected to the data lines. The upper plate 390 and lower plate 392 are bonded to have the Y pad are 394A, the common are 396 and the X pad area (not shown) exposed.

The heat proof plate 386 enables the heat generated at the PDP 370 to be easily emitted to the outside. For this, the heat proof plate 386 is installed to overlap the rear surface of the PDP 370 on the whole.

The control board 372 generates X, Y, Z timing control signals. And the control board 372 supplies the Y and Z timing control signal to the Y-Z integrated board 400 through a first conductive path 376, and the X timing control signal to the data driver board 380 through a second conductive path 378.

The data driver board 380 generates data pulses DP, as shown in FIG. 3, by use of the X timing control signal from the control board 372 and supplies the generated pulse to the data electrode lines of the PDP 370 through the X conductive path 388. Herein, the X conductive path 388 is connected to the data diver board 380 and the X pad area (not shown) which is provided at PDP 370.

The Y-Z integrated board 400 includes a scan driver board 373, a Y-Z sustainer board 374 and a connector 375 to connect the two boards 373, 374 with each other.

The scan driver board 373, as shown in FIG. 3, generates reset pulses RP which are to be supplied to the scan electrode lines in the reset period APD and scan pulses SP which are to be supplied in the address period APD by use of the Y timing control signal from the control board 372. And, the scan driver board 373 supplies the reset pulse RP and the scan pulse SP to the scan electrode lines of the PDP 370 through the Y conductive path 382.

The Y-Z sustainer board 374, as shown in FIG. 3, generates Y sustain pulses SUSPy that are to be supplied to the scan electrode lines and Z sustain pulses SUSPz that are to be supplied to the sustain electrode lines in the sustain period SPD by use of the Y and Z timing control signal from the control board 372, wherein the Y sustain pulse SUSPy or the Z sustain pulse SUSPz is alternately supplied. And, the Y-Z sustainer board 374, as shown in FIG. 3, generates bias pulses BP that are to be supplied to the sustain electrode lines in the reset period RPD and the address period APD. For this, the Y-Z sustainer board 374 includes a Y sustain circuit (not shown) to generate the Y sustain pulse SUSPy, and a Z sustain circuit (not shown) to generate the bias pulse BP and the Z sustain pulse SUSPz. The Y-Z sustainer board 374 supplies the Y sustain pulse SUSPy to the scan electrode lines through the Y pad 395 provided at the Y pad area 394A of the upper plate 390 of the PDP 370 via a path of "a connector 375→a scan driver board 373→the Y conductive path 382". And the Y-Z sustainer board 374 supplies the bias pulse BP and the Z sustain pulse SUSPz to the sustain electrode lines by supplying it to the first and second common electrode lines 391A, 391B which are commonly connected to the sustain electrode lines through the Z pad 397 provided at the Z pad area 394B of the non-display area of the upper side of the lower plate 392 of the PDP 370 via a Z conductive path 384. At this moment, the first common electrode line 391A and the second common electrode line 391B are connected to a connecting part 398. At this moment, the connecting part 398 is any one of a flexible flat cable or a flexible printed cable.

Herein, the Z conductive path 384, as shown in FIG. 16, is connected to the Y-Z sustainer board 374 and the Z pad 397 provided at the Z pad area 194B of the upper side of the lower plate 392 of the PDP 370.

In this way, the Y conductive path 382 is connected to the scan driver board 373 and the Z conductive path 384 is connected to the Y-Z sustainer board 374. Herein, the Y conductive path 382 is connected to the front surface(on the basis of PDP 370) or the rear surface of the scan driver board 373, and the Z conductive path 382 is connected to the front surface or the rear surface of the Y-Z sustainer board 374.

In case that the PDP module with such a configuration is driven, the current path is as follows in the sustain period SPD. Firstly, when the Y-Z sustainer board 374 supplies the Y sustain pulse SUSPy to the scan electrode lines of the PDP 370, a first current path is "Y-Z sustainer board 374→connector 375→scan driver board 373→Y conductive path 382→scan electrode line→panel capacitor→sustain electrode line→the first common electrode line 391A→connecting part 398→the second common electrode line 391B→Z conductive path 384→Y-Z sustainer board 374". And, when the Y-Z sustainer board 374 supplies the Z sustain pulse SUSPz to the sustain electrode lines of the PDP 370, a second current path is "Y-Z sustainer board 374→Z conductive path 384→the second common electrode line 391B→connecting part 398→the first common electrode line 391A→sustain electrode line→panel capacitor→scan electrode line→Y conductive path 382→scan driver board 373→connector 375→Y-Z sustainer board 374"

At this moment, each conductive path is any one of a flexible flat cable or a flexible printed cable.

In the PDP module, the second common electrode line 391B formed at the lower plate 392 can have an effect that electro-magnetic interference EMI with the control board 372 and the power board (not shown) is shielded by the heat proof plate 386.

Also, the Z pad 397 is formed at the upper side, which is the non-display area, of the PDP lower plate 392 to connect the Z conductive path 384 with the Y-Z sustainer board 374 in the shortest distance, thus the inductance is reduced to increase energy recovery efficiency. At the same time, it assembly process can be simplified by connecting the Y conductive path 382 and the Z conductive path 384 with the PDP 370.

As described above, the plasma display panel and the module thereof according to the embodiment of the present invention integrates the Y sustain circuit and the Z sustain circuit into one board to simplify the configuration of circuit board. Especially, the plasma display panel and the module thereof according to the embodiment of the present invention forms the common electrode lines commonly connected to the sustain electrode lines at the non-display area of the upper plate or the lower plate of the plasma display panel, and forms the Z pad connected to the common electrode lines at the non-display area of the upper side of the upper plate or the upper side of the lower plate of the plasma display panel to be connected with the Y-Z sustainer board in the shortest distance, thereby reducing the inductance to increase energy recovery efficiency. Also, the Y pad and the Z pad are formed to be connected with the Y-Z sustainer board in the shortest distance so that its assembly process can be simplified.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel module, comprising:

a plasma display panel having scan electrode lines, sustain electrode lines and data electrode lines formed at a display area, wherein the scan electrode lines and the sustain electrode lines are formed on an upper substrate along a first direction, and the data electrode lines are formed on a lower substrate along a second direction;

a common electrode line formed at a non display area of the display panel, wherein the common electrode line extends along a first side edge of the display panel and along at least one of an upper edge and a lower edge of the display panel, and wherein the common electrode line is commonly connected to the sustain electrode lines along the first side edge of the display panel;

a first pad portion formed at a non-display area on a second side edge of the display panel, wherein the scan electrode lines terminate in the first pad portion;

a second pad portion formed at a non-display area located at the upper edge or the lower edge of the display panel, wherein the second pad portion is connected to the common electrode line;

an integrated driving board to drive the scan electrode lines and the sustain electrode lines, wherein the integrated driving board generates first sustain pulses to be supplied to the scan electrode lines, and second sustain pulses to be supplied to the sustain electrode lines in a sustain period;

a first conductive path connected between the integrated driving board and the first pad portion, wherein the first conductive path extends in the first direction from the integrated driving board to the first pad portion; and a second conductive path connected between the integrated driving board and the second pad portion in a shortest distance, wherein the second conductive path extends in the second direction from the integrated driving board to the second pad portion, wherein the second direction is substantially perpendicular to the first direction, wherein the integrated driving board supplies the first sustain pulse to the scan electrode lines through the first conductive path and the first pad portion, and the second sustain pulse to the sustain electrode lines through the second conductive path connected to an output terminal of the integrated driving board, the second pad portion and the common electrode line.

2. The plasma display panel module according to claim 1, wherein the second conductive path is connected to any one of an upper edge or a lower edge of the integrated driving board.

3. The plasma display panel module according to claim 1, wherein the common electrode line includes:

a first portion formed along the first side edge of the plasma display panel to be commonly connected to the sustain electrode lines; and a second portion formed along at least one of the upper edge and the lower edge of the plasma display panel, wherein the second portion is connected to the first portion of the common electrode line.

4. The plasma display panel module according to claim 3, wherein the first portion and the second portion of the common electrode line are formed on the same substrate.

5. The plasma display panel module according to claim 1, wherein the first pad portion and the second pad portion are formed at the same substrate.

6. The plasma display panel module according to claim 1, wherein the first conductive path and the second conductive path are any one of a flexible flat cable or a flexible printed cable.

7. The plasma display panel module according to claim 1, wherein the integrated driving board includes:

a scan driver board to generate a scan pulse that is to be supplied to the scan electrode lines;

an integrated sustainer board to generate the first sustain pulses and the second sustain pulses; and a connector to connect the scan driver board with the integrated sustainer board.

8. The plasma display panel module according to claim 7, further comprising:

a heat proof plate to emit heat from the plasma display panel, wherein the heat proof plate is positioned between the lower substrate of the plasma display panel and the integrated driving board;

a data driver board to generate a data pulse that is to be supplied to the data electrode lines;

a control board to supply a corresponding signal to each of the scan driver board, the integrated sustainer board and the data driver board; and a power source board to supply required power to each of the boards.

9. A plasma display panel module, comprising:

a plasma display panel having scan electrode lines and sustain electrode lines formed on a upper substrate and a data electrode formed on a lower substrate;

a common electrode line formed at a non-display area of the upper substrate, wherein the common electrode line extends along a first side edge and along at least one of an upper edge and a lower edge of the upper substrate, and wherein the common electrode line is commonly connected to the sustain electrode lines;

a connection pad formed at a non-display area on the upper edge or the lower edge of the upper substrate, wherein the connection pad is connected to the common electrode line;

a heat insulating plate mounted behind the lower substrate;

an integrated driving board mounted on a rear surface of the heat insulating plate, wherein the integrated driving board electrical signals to drive the scan electrode lines and the sustain electrode lines;

a first conductive path connected between a side edge of the integrated driving board and the scan lines, wherein the first conductive path extends in a first direction; and a second conductive path connected between an upper edge or a lower edge of the integrated driving board and the connection pad in a shortest distance, wherein the second conductive path extends in a second direction, and wherein the second direction is substantially perpendicular to the first direction, wherein the integrated driving board supplies a first sustain pulse to the scan electrode lines through the first conductive path, and a second sustain pulse to the sustain electrode lines through the second conductive path connected to an output terminal of the integrated driving board, the connection pad and the common electrode line.

10. The plasma display panel module of claim 9, wherein the connection pad is formed on the upper edge of the upper substrate.

11. The plasma display panel module of claim 9, wherein the first conductive path makes a 180 degree bend around a side edge of the heat insulating plate.

12. The plasma display panel module of claim 11, wherein the second conductive path makes a 180 degree bend around an upper edge or a lower edge of the heat insulating plate.

13. The plasma display panel module of claim 9, wherein the second conductive path makes a 180 degree bend around an upper edge or a lower edge of the heat insulating plate.

14. The plasma display panel module of claim 9, further comprising a scan line pad portion formed on a non-display portion of a second side edge of the upper substrate, wherein the scan lines terminate in the scan line pad portion.

15. The plasma display panel module of claim 14, wherein the first conductive path is coupled to the scan lines in the scan line pad portion.

* * * * *